United States Patent [19]

McCord

[11] 4,367,098

[45] Jan. 4, 1983

[54] PROCESS FOR ULTRASONIC CLEANING USING TWO IMMISCIBLE FLUIDS

[76] Inventor: James W. McCord, 9101 Nottingham Pkwy., Louisville, Ky. 40222

[21] Appl. No.: 276,205

[22] Filed: Jun. 22, 1981

[51] Int. Cl.[3] ..... B08B 3/12

[52] U.S. Cl. ..... 134/1; 134/25.4; 366/127

[58] Field of Search ..... 134/1, 184, 25.4, 32, 134/26; 366/127

[56] References Cited

U.S. PATENT DOCUMENTS

| | | | |
|---|---|---|---|
| 2,616,820 | 11/1952 | Bourgeaux | 134/32 |
| 3,011,924 | 12/1961 | Rand | 134/32 |
| 3,021,235 | 2/1962 | Schumacher | 134/32 |
| 3,033,710 | 5/1962 | Hightower et al. | 134/1 |
| 3,094,469 | 6/1963 | Strauss et al. | 134/1 |

*Primary Examiner*—S. Leon Bashore, Jr.
*Assistant Examiner*—Michael L. Goldman

[57] ABSTRACT

A relative heavy immiscible fluid is used with water or a relatively light treating fluid in a treating tank under ultrasonic vibrating conditions and objects to be treated are immersed in the treating fluid.

4 Claims, 1 Drawing Figure

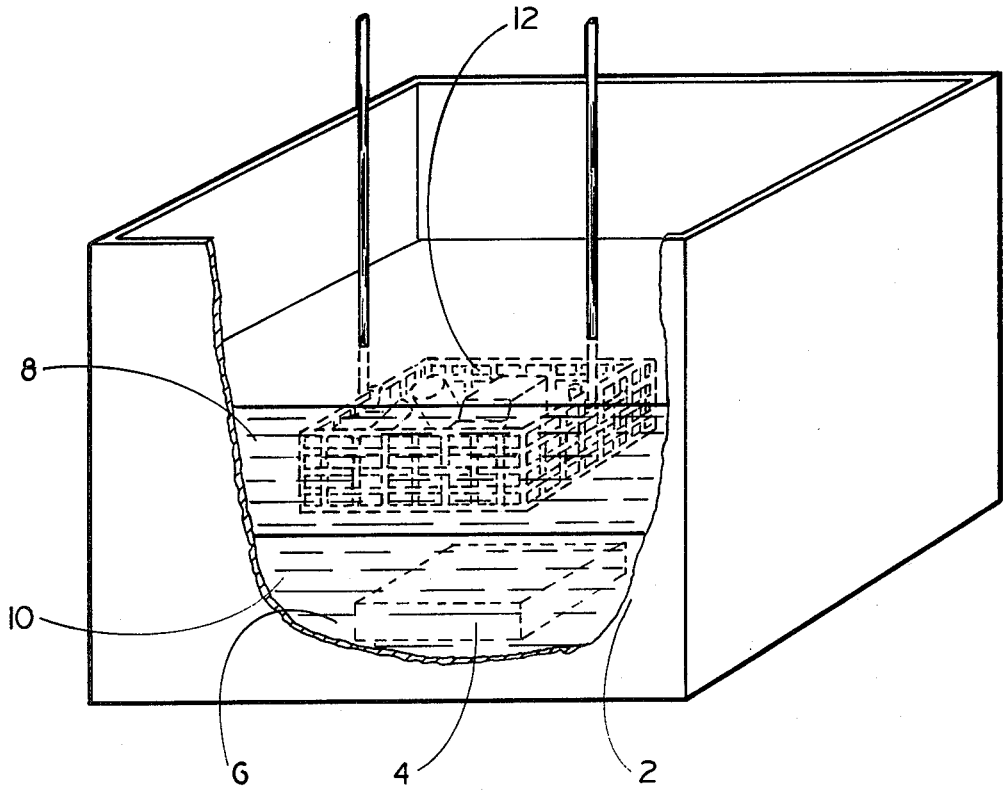
12
8
10
6
4
2

PROCESS FOR ULTRASONIC CLEANING USING TWO IMMISCIBLE FLUIDS

BACKGROUND OF THE INVENTION (a) Field of the Invention

This invention relates to an improved treating process. More particularly, this invention relates to the use of an immiscible relatively dense fluid with a lighter cleaning fluid under ultrasonic vibrating conditions as means for treating hard to clean objects.

(b) Description of the Prior Art

In the treating, particularly cleaning of hard to clean objects, such as metallic tools, plastic parts, and the like, the hard to clean objects are cleaned by immersion in a water-based cleaning solution. In many devices, ultrasonic vibrating means are used in combination with the cleaning solution to improve soil removal from the objects being cleaned. However, in the use of many liquids in combination with an ultrasonic vibrator, the vibrator is subjected to erosive and corrosive damage.

In U.S. Pat. No. 4,224,110, for example, two immiscible fluids are utilized and ultrasonic vibrating means are disclosed. In this reference, the ultrasonic vibrating means is in contact with the cleaning solvent.

SUMMARY OF THE INVENTION

In the present invention it is recognized that it is desirable to provide an improved process for treating objects, treating including, for example, cleaning or finishing processes. Furthermore, it is recognized that it is desirable to provide an improved treating method wherein erosive and corrosive cleaning or finishing fluids may be used with ultrasonic vibrators and the ultrasonic vibrators are not in contact with the cleaning or finishing fluids.

The present invention provides for the use of an ultrasonic transducer and generator system to cavitate water or other immiscible fluids using a heavier immiscible organic chemical wherein the more dense organic chemical acts as a coupling agent. The more dense organic chemical may or may not be a cleaning chemical but is used to protect the transducer surface from erosion and corrosion.

More particularly, the present invention provides a process for treating objects comprising the steps of: immersing an object to be treated into a second layer of a fluid in a tank having a cavitating liquid therein, the liquid including a first layer of a relatively heavy organic fluid and the second layer is of a lighter treating fluid immiscible with the first layer; and, removing the object from the liquid after a preselected period of time.

The heavier or first layer of organic chemicals which have been found useful in the present invention are usually halogenated organic compounds having two or less carbon atoms. These include, for example, trichloromonofluoromethane, trichlorotrifluoroethane, and methylene chloride, and the like.

Examples of immiscible lighter fluids or second layer fluids which may be used, include, but are not limited to, water, diluted acids, diluted bases, and mixtures with wetting agents therein.

In use, the heavier fluid is added to the tank in a sufficient quantity to cover and protect the transducer from erosion and corrosion by the lighter fluid. Upon starting the vibrator, the vibrations set up in the heavier fluid transmit vibratory waves to the lighter treating fluid. Upon immersion of an object to be treated, the object is immersed into the portion of the tank containing the lighter fluid and in most cases the treating is accomplished in less than one minute.

BRIEF DESCRIPTION OF THE DRAWING

The FIG. is a perspective view, partially cut away, of one preferred apparatus for use in the present invention.

DESCRIPTION OF THE PREFERRED EMBODIMENT

In the Figure, a chamber 2 is provided with an ultrasonic transducer 4 therein, transducer 4 being mounted to the bottom 6 for transmitting ultrasonic waves through two layers of fluids. The top or second layer may include water or a highly erosive or corrosive material, such as a diluted acid, base, or the like. The heavier or first liquid layer 10 is immiscible with the first layer 8 and during use (when the transducer 4 is vibrating) the first layer 10, which is usually a halogenated organic compound having two or less carbon atoms, encloses and protects the transducer.

The chamber 2 may be constructed of any compatible materials of construction and the ultrasonic transducer 4 may be any known in the art as long as it is sized to provide sufficient ultrasonic vibrations for providing the necessary cavitation in the two layers. The ultrasonic generator which powers the transducer is not shown and may be any known in the art which is compatible with the selected transducer.

In the treating process, the transducer is turned on thereby starting ultrasonic vibrations in the two layers of fluids. Objects to be treated are then immersed in the vibrating liquid for a short period of time and then removed.

A more comprehensive understanding of the invention can be obtained by considering the following example. However, it should be understood that the example is not intended to be unduly limitative of the invention.

EXAMPLE

In a cleaning tank containing an upper layer of a hydrochloric acid solution of about 10% hydrochloric acid in water on top of a layer of trichlorotrifluoroethane, a basket of corroded steel components for a diesel engine is immersed. The tank is provided with an ultrasonic transducer, driven by an ultrasonic generator, which transmits 25 KHZ at a power of 900 watts.

The basket of parts is immersed in the top layer for about one minute and then removed and rinsed in water to remove the acid film.

The removed parts are substantially free of the corrosion.

What is claimed is:

1. A process for cleaning objects in a system comprising a first layer of a relatively heavy liquid and a second layer of cleaning liquid lighter than, immiscible with and layered on top of the first layer of liquid, said system having an ultrasonic vibrating means immersed in the first layer of relatively dense liquid thereby protected from the effects of the cleaning liquid of the second layer, the ultrasonic vibrating means creating cavitation in said first and second layers, comprising the steps of: immersing the objects to be cleaned only in the second layer of cleaning liquid during said cavitation and removing the objects from the second layer of cleaning liquid after a preselected period of time.

2. The process of claim 1 wherein the temperature of the liquid is ambient.

3. The process of claim 1 wherein said first layer is a halogenated organic compound having two or less carbon atoms.

4. The process of claim 1 wherein said immersion time is about one minute or less.

* * * * *